US009190749B2

(12) United States Patent
Chen et al.

(10) Patent No.: US 9,190,749 B2
(45) Date of Patent: Nov. 17, 2015

(54) ELECTRICAL CONNECTOR AND ELECTRICAL CONTACTS OF THE SAME

(71) Applicant: HON HAI PRECISION INDUSTRY CO., LTD., New Taipei (TW)

(72) Inventors: Ming-Yue Chen, New Taipei (TW); Wen-Yi Hsieh, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/161,615

(22) Filed: Jan. 22, 2014

(65) Prior Publication Data

US 2014/0213113 A1 Jul. 31, 2014

(30) Foreign Application Priority Data

Jan. 28, 2013 (TW) ..... 102103070 A

(51) Int. Cl.

| | |
|---|---|
| ***H01R 11/18*** | (2006.01) |
| ***H01R 12/71*** | (2011.01) |
| ***H01R 13/24*** | (2006.01) |
| *H01R 12/73* | (2011.01) |
| *H01R 13/08* | (2006.01) |

(52) U.S. Cl.

CPC ..... *H01R 12/714* (2013.01); *H01R 13/2407* (2013.01); *H01R 12/73* (2013.01); *H01R 13/08* (2013.01)

(58) Field of Classification Search

CPC ..... H01R 13/2421; H01R 13/2428; H01R 13/2435; H01R 33/46; H01R 11/18; H01R 23/722; H01R 9/096

See application file for complete search history.

(56) References Cited

U.S. PATENT DOCUMENTS

| | | | | |
|---|---|---|---|---|
| 6,685,492 | B2 | 2/2004 | Winter et al. | |
| 7,025,602 | B1 | 4/2006 | Hwang | |
| 7,972,184 | B2 * | 7/2011 | Hsieh et al. | 439/700 |
| 8,033,872 | B2 * | 10/2011 | Yang et al. | 439/700 |
| 8,157,601 | B2 * | 4/2012 | Lin et al. | 439/700 |
| 8,231,416 | B2 * | 7/2012 | Johnston et al. | 439/824 |
| 8,262,419 | B2 * | 9/2012 | Chen et al. | 439/700 |
| 8,591,270 | B1 * | 11/2013 | Ramsey et al. | 439/824 |
| 2004/0214475 | A1 * | 10/2004 | Costello et al. | 439/700 |
| 2012/0171907 | A1 * | 7/2012 | Rathburn | 439/700 |
| 2012/0238136 | A1 * | 9/2012 | Hwang | 439/607.01 |

* cited by examiner

*Primary Examiner* — Gary Paumen

(74) *Attorney, Agent, or Firm* — Wei Te Chung; Ming Chieh Chang

(57) ABSTRACT

An electrical contact for being loaded in an electrical connector electrically connecting an IC module to a printed circuit board (PCB) includes a first contact, a second contact and an elastic arm. The first contact includes a first mating portion and a first connecting portion. The first mating portion defines a first contacting end for connecting with the IC socket. The second contact includes a second mating portion and a second connecting portion. The second contacting portion defines a second contacting end for connecting with the PCB. The first and second connecting portions are coupled with each other, the first elastic element rings around the first mating portion of the first contact and presses against the second connecting portion of the second contact.

15 Claims, 5 Drawing Sheets

ELECTRICAL CONNECTOR AND ELECTRICAL CONTACTS OF THE SAME

BACKGROUND OF THE INVENTION

1. Field of the Invention

The present invention relates to an electrical connector and electrical contacts thereof, particularly to a test socket mounted on a printed circuit.

2. Description of Related Art

Electrical connector is widely used in the electrical field. Taiwan Patent No. I360922 discloses an electrical contact for an electrical connector. The contact comprises a first contact and a second contact electrically coupled to the first contact, and an elastic element. The first contact includes a base portion, a pair of protrusions and a connecting portion. The second contact has a similar structure to the first contact. The elastic arm is retained between the protrusions of the first contact and second contact. However, the connecting portions of the first and second contacts may be misplaced when mated with an IC socket.

Hence, an improved electrical connector is desired.

BRIEF SUMMARY OF THE INVENTION

Accordingly, an object of the present invention is to provide an electrical connector electrically connecting an IC module to a printed circuit board.

To achieve the above object, an electrical contact for being loaded in an electrical connector electrically connecting an IC module to a printed circuit board (PCB) includes a first contact, a second contact and an elastic arm. The first contact includes a first mating portion and a first connecting portion. The first mating portion defines a first contacting end for connecting with the IC socket. The second contact includes a second mating portion and a second connecting portion. The second contacting portion defines a second contacting end for connecting with the PCB. The first and second connecting portions are coupled with each other, the first elastic element rings around the first mating portion of the first contact and presses against the second connecting portion of the second contact.

DETAILED DESCRIPTION OF THE PREFERRED EMBODIMENTS

Figure 1:
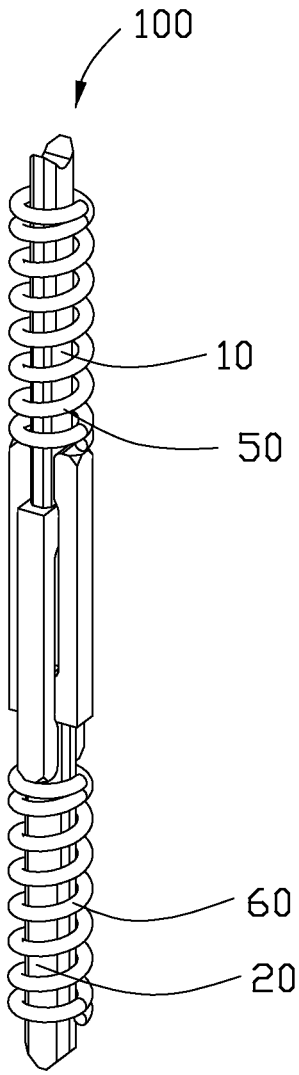
FIG. 1 is an assembled view of an electrical contact of a preferred embodiment of the present invention.
Figure 2:
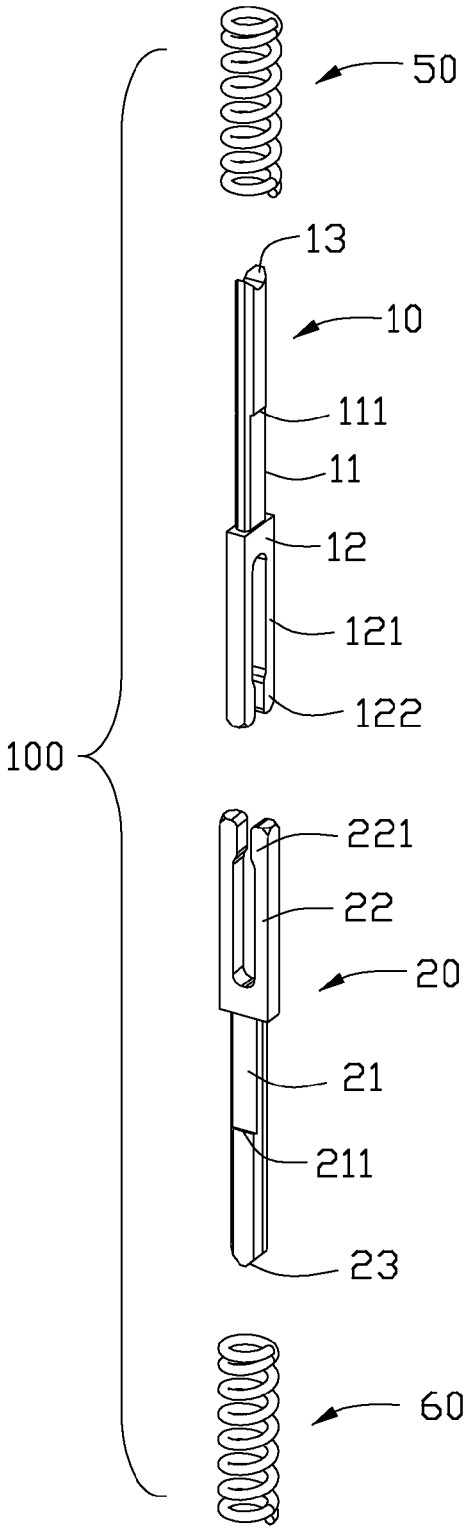
FIG. 2 is an exploded view of the electrical contact in a second view as shown in FIG. 1.

Reference will now be made to the drawing figures to describe the preferred embodiment of the present invention in details. FIGS. 1~2 illustrate an electrical contact 10 which used to be loaded in an electrical connector connecting an IC module 200 to a printed circuit board 300.

Reference to FIGS. 1~2, the electrical contact 100 comprises a first contact 10, a second contact 20 coupled with the first contact, a first elastic element 50 and a second element 60. The first and second contacts are same to each other in structure and are coupled with each other orthogonality. In the preferred embodiment, the first and second elastic elements are expansion-contraction springs.

The first contact 10 comprises a first mating portion 11 and a connecting portion 12 extending from a lower end of the first mating portion. The second contact 20 comprises a second mating portion 21 and a second connecting portion 22 extending from an upper end of the second mating portion. The first connecting portion 12 defines a pair of first elastic arms 121. A pair of locking hooks 122 defined at the lower inside ends of the first elastic arms 121 clamp opposite surfaces of the second contacting portion 21. And the second connecting portion 22 also defines a pair of second elastic arms 221 with locking hooks clamping opposite surfaces of the first contacting portion 11. Through the elastic arms clamping corresponding mating portions, an electric path is formed between the first contact 10 and the second contact 20. The free ends of the first and second mating portions are defined as contacting ends 13, 23. The first contacting end 13 and the second contacting end 23 are adapted for connecting with the IC module 200 to the printed circuit board 300 respectively. The first and second elastic elements 50, 60 are put around the first and second mating portions 11, 21 respectively.

Figure 3:
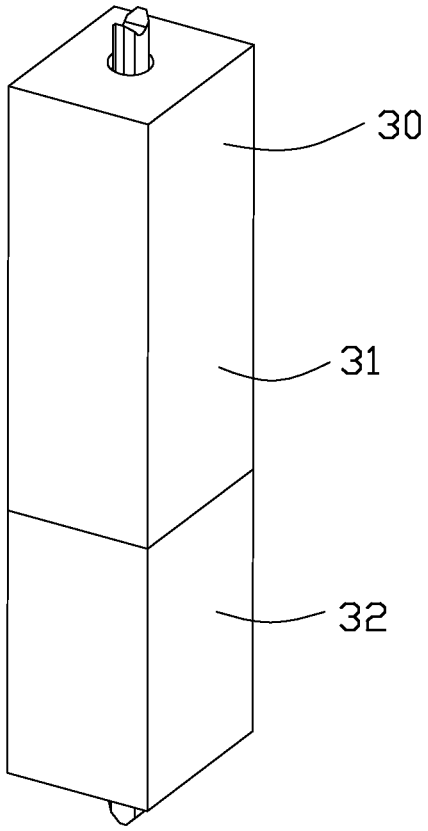
FIG. 3 is a general view of the electrical connector with one said electrical contact of a preferred embodiment of the present invention.

Combining with FIG. 3, a plurality of the electrical contacts 10 is assembled to an insulative housing 30 in an inserting direction, thereby forming the electrical connector (only one contact 10 is shown and the insulative housing is simplified). The insulating housing 30 includes a first housing 31 and a second housing 32 (both partially shown). Combination with FIGS. 4 and 5, the first housing 30 defines a mating face 311 confronting for the IC module 200 and the second housing 32 defines a mounting face 321 confronting for the printed circuit board 300. A plurality of contact passageways 33 are defined when the first and second housings are coupled with each other. The contact passageways 33 run through the mating face 311 and the mounting face 312 and receive said contacts.

Figure 4:
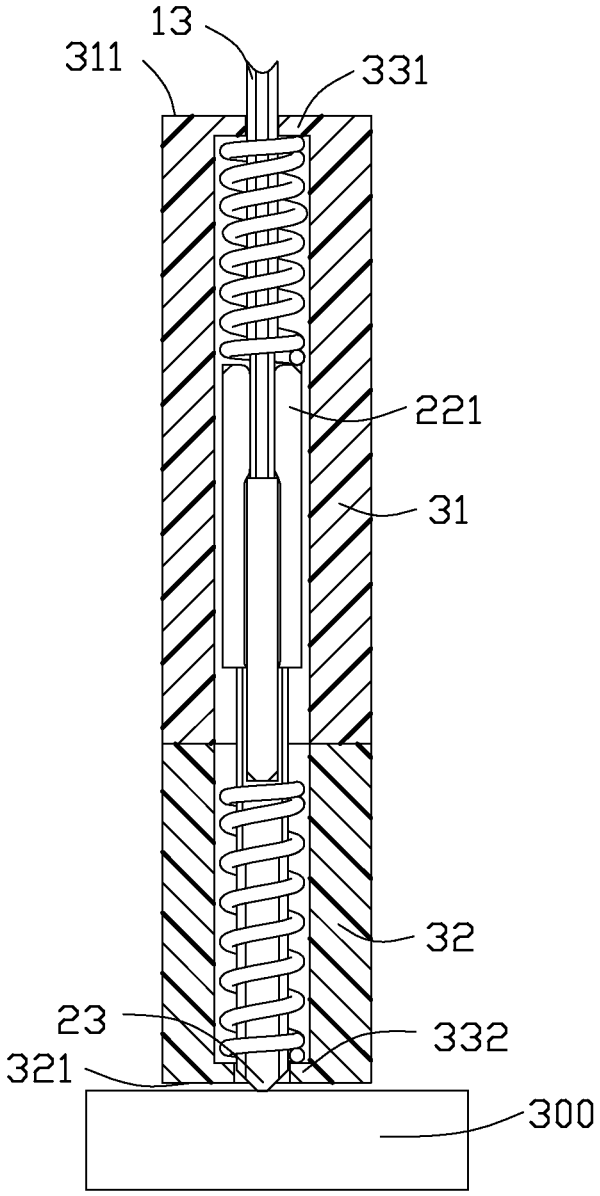
FIG. 4 is a cross-sectional schematic view of the electrical connector mounted to a printed circuit board.

Referring to FIG. 4, the electrical connector is mounted to printed circuit board 300. Each contact passageway 33 defines a first stopping portion 331 adjacent to the mating face 311 and a second stopping portion 332 adjacent to the mounting surface 321. The first and second contacts are retained in the contact passageways 33 by the first and second stopping portions 331, 332. Only the first contacting end 13 and the second contacting end 23 are exposed beyond the mating face 311 and the mounting face 321. The first elastic element 50 rings about the first mating portion 11. An upper end of the first elastic element 50 is pressed against the first stopping portion 331 and the lower end is pressed against the upper end of the connecting portion 22. When the first elastic element 50 is in an original form without an IC module 200 set, the first elastic element is in a free state or just in a slightly compressed state. The pair of second elastic arms 221 is able to move up and down. The second elastic element 60 rings around the second mating portion 21 and limited between the lower ends of the second connecting portion 22 and the second stopping portion 332. In a preferred embodiment, the second elastic element 60 is in a free state, the second elastic element 60 touches the second stopping portion 332 and spaces apart from the first connecting portion 12 by its own gravity. In other embodiments, the second elastic element 60 also could be touched or pressed against the first connecting portion 12.

Figure 5:
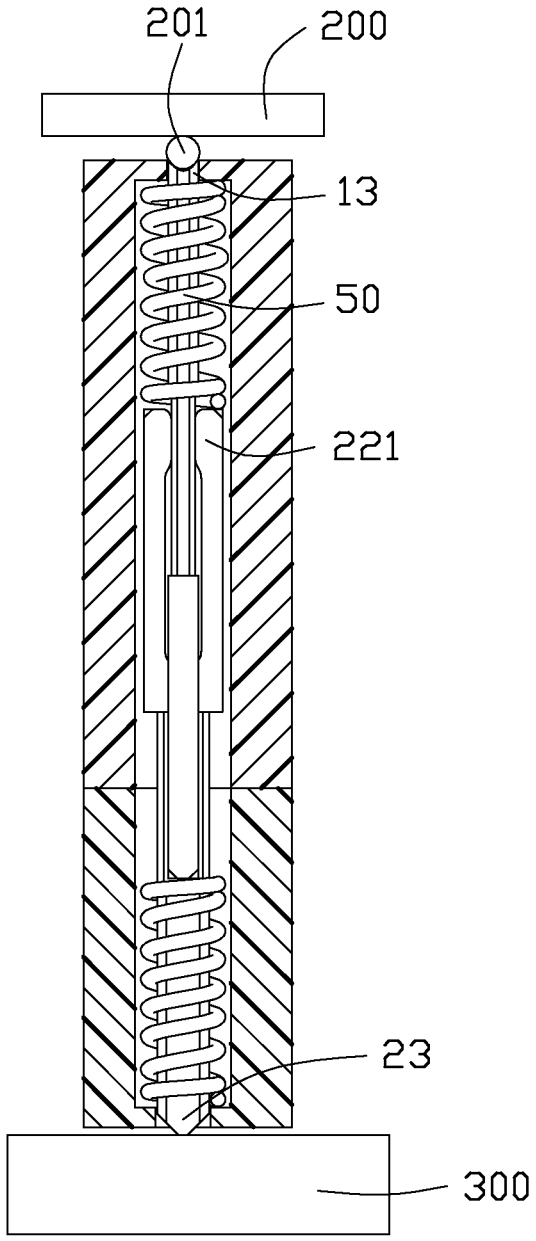
FIG. 5 is a cross-sectional schematic view of the electrical connector when mated to with an IC module.

Combining with FIGS. 4 and 5, the IC module 200 is mated with the electrical connector, thereby establish an electrical connection with the PCB. The IC module 200 includes a plurality of solder balls 201 which confront with the contacting ends 13 of the contacts 10. When the IC module is assembled to the electrical connector, the first contact 10 is pushed downward by the solder balls 201 the second elastic element 60 are compressed and shifted downwards by the downwards-shifting of first connecting portion 12, and the pair of first elastic arms sliding along the second mating portion 21 of the second contact 20. Please notes, the second connecting portion 22 are still coupled with the first mating portion 11 ensuring a good electrical connection between said two contacts. When the second elastic element 60 is compressed to a fixed length, the first elastic element is also compressed by the first mating portion 11. Certainly, only one elastic element is also able to achieve the goal. The stopping portions 331, 321 could limit the motions of the first and second contacting ends along a horizontal direction perpendicular to the inserting direction.

The mating portions 11, 21 define stopping faces 111, 211 adjacent to the connecting portions 12, 22, respectively, therefore each the mating portion is divided into two portions, one portion adjacent to the connecting portion is co-plane with the corresponding connecting portion. The stopping faces 111, 211 could stop the elastic arms 121, 221 and protect the elastic elements form over-deformed.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical contact for being loaded in an electrical connector electrically connecting an IC module to a printed circuit board (PCB), comprising:

a first contact comprising a first mating portion and a first connecting portion, the first mating portion defining a first contacting end for connecting with the IC socket;

a second contact comprising a second mating portion and a second connecting portion, the second contacting portion defining a second contacting end for connecting with the PCB; and a first elastic element;

wherein the first and second connecting portions are coupled with each other, the first elastic element rings around the first mating portion of the first contact and presses against the second connecting portion of the second contact; wherein the electrical contact further comprises a second elastic element, and the second elastic element rings around the second mating portion and presses against the first connecting portion of the first contact.

2. The electrical contact as claimed in claim 1, wherein the first and second contact are same to each other in structure and are coupled with each other orthogonally.

3. The electrical contact as claimed in claim 2, wherein the second connecting portion defines a pair of second elastic arms clamping on opposite surfaces of the first mating portion, the first mating portion defines stopping faces at the opposite faces thereof respectively, the pair of second elastic arms move toward the first mating portion below the stopping faces.

4. An electrical connector comprising:

an insulative housing comprising a first housing, a second housing and contact passageways defined by the first and second housings coupled with each other, each contact passageways defining a stopping portion adjacent to opposite surfaces of the insulative housing respectively; and electrical contacts received in the contact passageways, each electrical contact comprising a first contact, a second contact and a first elastic element;

wherein the first contact defines a pair of elastic arms clamping the second contact, the first elastic element is limited between free ends of the elastic arms and one of the stopping portions.

5. The electrical connector as claimed in claim 4, wherein opposite ends of the first elastic element press against the free ends of the first elastic arms and said stop portion severally.

6. The electrical connector as claimed in claim 4, wherein the second contact comprises a second pair of second elastic arms clamping the first contact and retaining a second elastic element accompany with the second stopping portion.

7. The electrical connector as claimed in claim 4, wherein the first contact and the second contact are of the same shape and clamp each other perpendicularly.

8. An electrical connector comprising:

an insulative housing defining a plurality of passageways extending therethrough in a vertical direction between opposite upper and lower mating surfaces;

a plurality of contact units disposed in the corresponding passageways, respectively, each of said contact units including:

an upper contact and a lower contact opposite to and moveable relative to each other in the vertical direction;

an upper spring located transversely around the upper contact and downwardly abutting against and urging the lower contact; and a lower spring located transversely around the lower contact and upwardly abutting against and urging the upper contact.

9. The electrical connector as claimed in claim 8, wherein the lower spring defines a lower end seated upon a lower shoulder of the housing in the corresponding passageway, and the upper spring defines an upper end seated upon an upper shoulder of the housing in the corresponding passageway.

10. The electrical connector as claimed in claim 8, wherein said upper contact defines an upper contacting pin and a lower downward fork-shaped upper connecting portion, and said lower contact defines a lower contacting pin and an upper upward fork-shaped lower connecting portion interlocked with the upper connecting portion in an intersectional manner without relative rotation therebetween about the vertical direction.

11. The electrical connector as claimed in claimed in claim 8, wherein said upper contact defines an upward engaging step structure, and said lower contact defines a downward engaging step structure to be engaged with upward engaging step structure in the vertical direction when no external electrical part applies forces upon either the upper contact or the lower contact.

12. The electrical connector as claimed in claim 11, wherein said upper contact defines a downward fork-shaped upper connecting portion, and said lower contact defines an upward fork-shaped lower connecting portion interlocked with the upper connecting portion in an intersectional manner without relative rotation therebetween about the vertical direction, and the upward engaging step structure is formed around a root area of the downward U-shaped upper connecting portion of the upper contact while the downward engaging step structure is formed around a free end of the upward U-shaped lower connecting portion of the lower contact.

13. The electrical connector as claimed in claim 12, wherein said upper contact defines another upward engaging step structure around a free end of the downward U-shaped upper connecting portion, and the lower contact another downward engaging step structure around a root area of the upward U-shaped engaging step structure to be engaged with said another upward engaging step structure in the vertical direction.

14. The electrical connector as claimed in claim 8, wherein said upper contact and said lower contact are essential same with each other, and the upper spring and the lower spring are essentially same with each other.

15. The electrical connector as claimed in claim 8, wherein when the lower contact is urged by an external electrical part to move upward to compress the upper spring in a tensioned manner, the upper contact is still relatively free in an unloaded manner if no external electrical part imposes forces upon the upper contact.

* * * * *